US011484773B2

(12) United States Patent
Mich'l

(10) Patent No.: US 11,484,773 B2
(45) Date of Patent: Nov. 1, 2022

(54) FOLDING AND COLLAPSIBLE SNOWBOARD POLE MOUNTING SYSTEM

(71) Applicant: Darin Mich'l, Huntsville, UT (US)

(72) Inventor: Darin Mich'l, Huntsville, UT (US)

( * ) Notice: Subject to any disclaimer, the term of this patent is extended or adjusted under 35 U.S.C. 154(b) by 0 days.

(21) Appl. No.: 17/525,835

(22) Filed: Nov. 12, 2021

(65) Prior Publication Data

US 2022/0072407 A1 Mar. 10, 2022

Related U.S. Application Data

(63) Continuation of application No. 16/727,352, filed on Dec. 26, 2019, now abandoned.

(51) Int. Cl.

| | |
|---|---|
| ***A63C 5/03*** | (2006.01) |
| ***A63C 11/02*** | (2006.01) |
| ***A63C 11/22*** | (2006.01) |

(52) U.S. Cl.

CPC ..... *A63C 11/025* (2013.01); *A63C 11/221* (2013.01); *A63C 11/227* (2013.01)

(58) Field of Classification Search

CPC ... A63C 11/221; A63C 11/025; A63C 11/227; A63C 5/03; A63C 10/00; A63C 10/28; A63C 11/00; A63C 11/10; A63C 11/222; A63C 11/228; A63C 11/24; A63C 2203/06; A63C 5/02; A42B 1/00

USPC ..... 280/823

See application file for complete search history.

(56) References Cited

U.S. PATENT DOCUMENTS

| | | | | |
|---|---|---|---|---|
| 3,730,544 | A * | 5/1973 | Hyman | A63C 11/22 135/65 |
| 5,427,390 | A * | 6/1995 | Duncan | B62B 19/02 280/47.38 |
| 6,217,072 | B1 * | 4/2001 | Gregg | A45B 1/04 224/267 |
| 6,217,073 | B1 * | 4/2001 | Hoffman | A63C 11/221 135/70 |
| 6,345,843 | B1 * | 2/2002 | Barnes | A63C 5/06 280/823 |
| 7,484,765 | B2 * | 2/2009 | Harper | A63C 11/10 280/809 |
| 7,658,413 | B2 * | 2/2010 | Malone | A63C 10/00 280/14.22 |
| 8,235,423 | B2 * | 8/2012 | Starry | A63C 11/00 280/814 |
| 8,528,930 | B2 * | 9/2013 | Titterington | G03B 17/561 280/623 |
| 9,609,925 | B2 * | 4/2017 | Lenhart | A45B 9/00 |
| 9,974,366 | B2 * | 5/2018 | Heim | A63C 11/22 |
| 10,286,288 | B1 * | 5/2019 | Gross | A63C 5/07 |

(Continued)

FOREIGN PATENT DOCUMENTS

GB 2487184 A * 7/2012 ..... A63C 10/28

*Primary Examiner* — James A Shriver, II
*Assistant Examiner* — Hilary L Johns
(74) *Attorney, Agent, or Firm* — Steven Rinchart

(57) ABSTRACT

A detachable snowboard and snowboard pole with a collapsible shaft divided into segments, a basket tip, and a handle. In exemplary embodiments, the pole affixes to a planar top surface of the snowboard using a mounting system comprising a plurality of clamps at staggered attachment points, each clamp adapted to form a friction fit with segments of the snowboard pole, each clamp oriented in parallel with one another.

18 Claims, 7 Drawing Sheets

(56) References Cited

U.S. PATENT DOCUMENTS

| | | | | |
|---|---|---|---|---|
| 2004/0007837 | A1* | 1/2004 | Sullivan | A63C 5/06 280/14.27 |
| 2006/0273570 | A1* | 12/2006 | Silverman | F16B 7/105 280/819 |
| 2007/0087920 | A1* | 4/2007 | Dachraoui | A63B 21/0552 482/121 |
| 2012/0119045 | A1* | 5/2012 | Gaal | F16B 7/0433 248/219.4 |
| 2014/0041702 | A1* | 2/2014 | Yamamoto | A61H 3/06 135/65 |
| 2015/0329189 | A1* | 11/2015 | Spencer | B63H 1/32 440/21 |
| 2019/0255421 | A1* | 8/2019 | Gross | A63C 5/07 |

* cited by examiner

FOLDING AND COLLAPSIBLE SNOWBOARD POLE MOUNTING SYSTEM

FIELD OF THE INVENTION

This invention relates to snowboards and more particularly relates to a snowboard and collapsible snowboard pole assembly.

BACKGROUND

Description of the Related Art

Typically, snowboards secure a users' feet in fixed positions in spaced-apart bindings oriented at a roughly perpendicular angle to the snowboarder's direction of movement. Snowboarders feet move independently of each other and the direction of travel of the snowboard to steer the snowboarder's travel on an inclined surface.

Snowboarders traditionally have not used poles as skiers do, which are not practical given the hand movements and maneuvers in motion required of snowboarders. There are instances, however, when a snowboarder is at rest and needing to change downhill starting positions, when a snowboarder cannot maneuver with both feet planted on the snowboard. This can occur when a snowboarder needs to move up an inclined surface or traverse a planar surface. A pole is useful in these circumstances to a snowboarder, but there are no convenient means in the art of carrying one.

Snowboarders have to take their feet out of the bindings when they encounter uphill such terrain so they can maneuver to a downhill area. Getting on chairlifts is another example of a situation in which a snowboarder needs to take the boots out of the bindings to maneuver into position. Skiers do not face similar difficulty.

Snowboarders often try to carry or pack a full size solid or foldable, or retractable pole and carry it with them in some form to help with these occasions. Full size poles are typically too large, unsafe and unwieldy to carry while snowboarding. Foldable or retractable poles are not easy or quick to access in a backpack. Poles designed to be foldable or retractable are typically made for hiking or trekking and are of very lightweight and not very strong design. They are typically not strong enough to be utilized for strong lateral application required by snowboarders. They are also typically too long and weak for efficient snowboard use.

Although the art includes some snowboarding poles which can be attached to either snowboards, to the lower legs of snowboarder, or to snowboard bindings, there exists a need in the art for a snowboarding pole which can be more efficiently transported without interfering with the snowboarders' ability to maneuver.

SUMMARY

From the foregoing discussion, it should be apparent that a need exists for a detachable snowboard pole attachment assembly. Beneficially, such an assembly would enhance the ability of a snowboarder to carry a pole.

The present invention has been developed in response to the present state of the art, and in particular, in response to the problems and needs in the art that have not yet been fully solved by currently available snowboards. Accordingly, the present invention has been developed to provide a a detachable snowboard pole attachment assembly, the snowboard pole assembly comprising: a snowboard having a top surface and two boot bindings, each boot binding comprising a clamp; a first affixment assembly comprising a collapsible pole and a plurality of clamps affixed to the top surface of the snowboard, the clamps affixed in parallel orientation, staggered across the top surface of the board, the clamps adapted to form a friction fit with a collapsible pole, the clamps comprising a mounting bracket, wherein the first affixment assembly is positioned forward of the boot bindings; a second affixment assembly comprising a collapsible pole and a plurality of clamps affixed to the top surface of the snowboard, the clamps affixed in parallel orientation, staggered across the top surface of the board, the clamps adapted to form a friction fit with a collapsible pole, the clamps comprising a mounting bracket, wherein the second affixment assembly is positioned rearward of the boot bindings; a collapsible pole having a plurality of interconnected segments, each segment received by a clamp. The snowboard pole attachment assembly may comprise a top surface which is one of planar and concave.

The plurality of clamps may be mounted either forward of the bindings or rearward of the bindings. The snowboard may consists of three clamps. The clamps may be oriented substantially in parallel with one or more of the bindings.

Each clamp may comprise two rollers. Two of the clamps may be spaced in close proximity to one another such that a distance between a second and third clamp exceeds the distance between a first and second clamp.

A distance between a tip of a forward binding and the first clamp may be substantially equal to a distance between the tip of the forward binding and the third clamp.

A distance between a tip of a forward binding and the first clamp is substantially equal to a distance between the tip of the forward binding and the second clamp. The pole may comprises three segments. The clamps may be oriented at 20 to 45 degrees off a long axis of the snowboard.

The snowboard pole attachment assembly may further comprise one or more handles affixed to two or more of the clamps including the clamps affixed to the of the bindings.

The snowboard pole assembly may consist or comprise: a snowboard having a top surface and two boot bindings; a first affixment assembly comprising a collapsible pole and a plurality of clamps affixed to the top surface of the snowboard, the clamps affixed in parallel orientation, staggered across the top surface of the board, the clamps adapted to form a friction fit with a collapsible pole, the clamps comprising a mounting bracket; a plurality of secondary clamps affixed in parallel within five inches of a side of the snowboard; a collapsible pole having three segments, each segment received by a clamp; wherein the top surface is one of planar and concave; wherein the snowboard consists of three clamps; wherein the clamps are oriented substantially in parallel with one or more of the bindings; wherein the clamps are oriented at 20 to 45 degrees off a long axis of the snowboard.

The clamps may be adhered to the top surface of the snowboard in some embodiments. The clamps may comprise a baseplate abutting the snowboard shaped as one of square, circular, avoid, rectangular, octagonal, polygonal, and triangular. The baseplates may be formed as a single integrated piece.

Another detachable snowboard pole attachment assembly is also provided, the snowboard pole assembly consisting of: a snowboard having a top surface and two boot bindings, the snowboard defining a plurality of recesses adapted to receive a mounting plate of a clamp; a first affixment assembly comprising a collapsible pole and a plurality of clamps affixed to the top surface of the snowboard, the clamps affixed in parallel orientation, staggered across the top surface of the board, the clamps adapted to form a friction fit with a collapsible pole, the clamps comprising a mounting bracket; a plurality of secondary clamps affixed in parallel within five inches of a side of the snowboard; a collapsible pole having three segments, each segment received by a clamp; wherein the top surface is one of planar and concave; wherein the snowboard consists of three clamps; wherein the clamps are oriented substantially in parallel with one or more of the bindings; wherein the clamps are oriented at 20 to 45 degrees off a long axis of the snowboard.

The snowboard pole attachment assembly may further comprise a flexible, polymeric handle interconnected two clamps.

Further objects and advantages of this invention will become apparent from the following description referring to the accompanying drawing, and the features of novelty which characterize this invention will be pointed out with particularity in the claims appended to and forming a part of this specification.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

It is an object of the present invention to provide a foldable, retractable snowboard pole and snowboard mounting system for said pole specifically adapted for strength and compact positioning when retracted. In various embodiments, the pole breaks down into 2-4 segments before being mounted on a forward segment of a snowboard. The pole is design to be lightweight and to quickly release from mounting clips on the front of the snowboard in a manner which does not hamper snowboard function and which is safe and convenient, and which permits the snowboard to be stored when not in use with the retracted pole detachably affixed in place.

Figure 1:
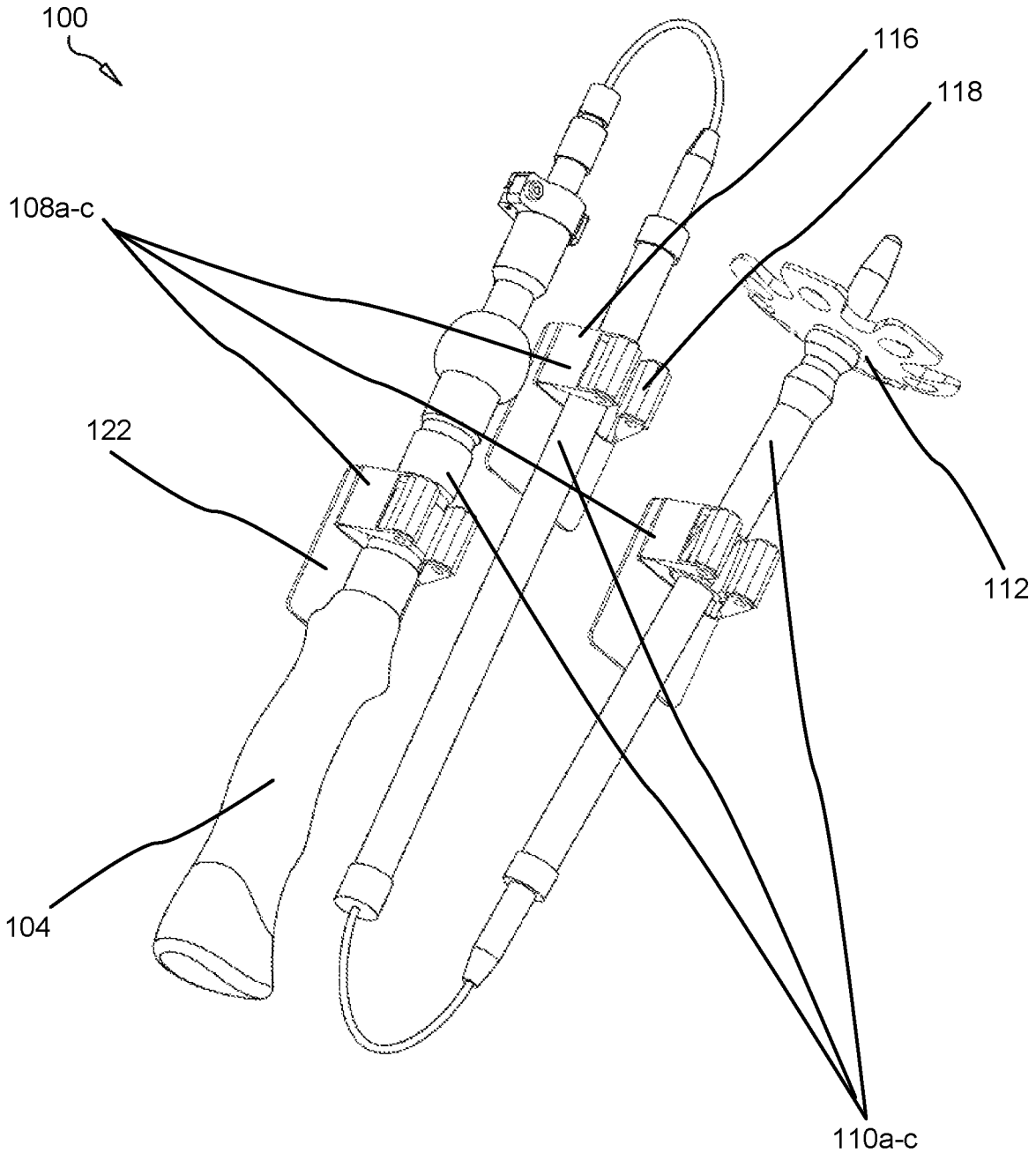
FIG. 1 is an isometric, top perspective view illustrating one embodiment of a detachable snowboard pole assembly in accordance with the present invention.

FIG. 1 is an isometric, top perspective view illustrating one embodiment of a detachable snowboard pole assembly 100 in accordance with the present invention. The assembly comprises a pole 100 and a plurality of bindings 108*a-c*.

The pole 104 comprises three elongated segments 110 in the shown embodiment, but may comprise two, four, or more. The pole 104 may telescope as known to those of skill in the art. The lower segment 110*a* slides into the middle segment 110*b* which then slides into the upper pole segment 110*c*. The pole 104 comprises a palm-grip handle which may be heat-pressed onto the lower segment 110*a*. The segments may be joined by a single cable traverses each segment 110 through their long axis.

In various embodiments, a plurality of clamps 108*a-c* are affixed at predetermined intervals and orientations on a top surface 210 of the snowboard 202. The clamps 108 are positioned at attachment points on the top surface 210 of the snowboard 202.

Each clamp 108 may comprise a spring-biased bulldog clamp or a clamp having a plurality of prongs 116 adapted to partially envelope a pole 104 and form a friction fit therewith. The prongs 116 may comprise a roller 118 adapted to facilitate receipt of the pole segment when forced into the clamp 108.

The clamps 108 (or clips) each comprise a baseplate 122 which affixes to the top of the snowboard. This baseplate 122 may adhered to the snowboard, including using two-sided tape. In alternative embodiments, the baseplate 122 magnetically affixes to the snowboard. In some embodiments, the baseplates 122 of each clamp 108 are formed as a single integrated piece which spans the snowboard. The clamps 108 and baseplate 122 may all be formed as a single integrated piece.

The clamps in the shown embodiment are mounted forward of the bindings, but may also be mounted rearward of the bindings.

In various embodiments, the baseplate 122 (or mounting plate 122) may be rectangular, square, circular, triangular, ovoid, octagonal, polygonal, or irregularly-shaped.

Figure 2:
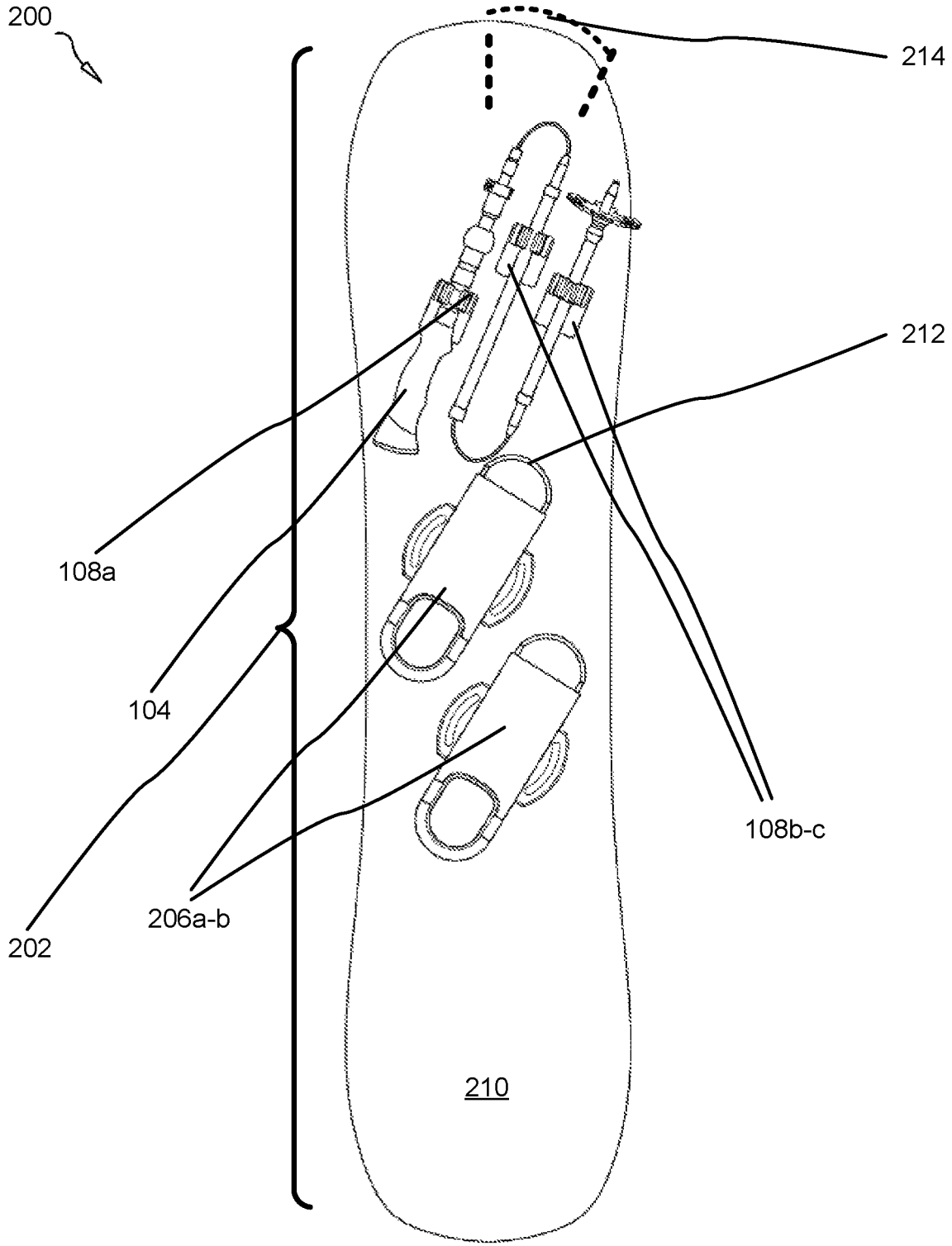
FIG. 2 is an environmental, top perspective view illustrating one embodiment of a detachable snowboard pole assembly in accordance with the present invention.

FIG. 2 is an environmental, top perspective view illustrating one embodiment of a detachable snowboard pole 200 assembly in accordance with the present invention.

In various embodiments, the clamps 108 are staggered on the top surface 210 of the board 202 in parallel orientation to one another such that the clamps are also in parallel with one or more of the bindings 206.

The distance between clamp 108*a* and the forward tip 212 of the binding is substantially equal to the distance between the forward tip 212 of the binding and the clamp 108*c*, as well as clamp 108*b* in some embodiments.

In various embodiments, the clamps 108 are oriented at 20 to 45 degrees 214 off a long axis of the snowboard as shown.

Figure 3:
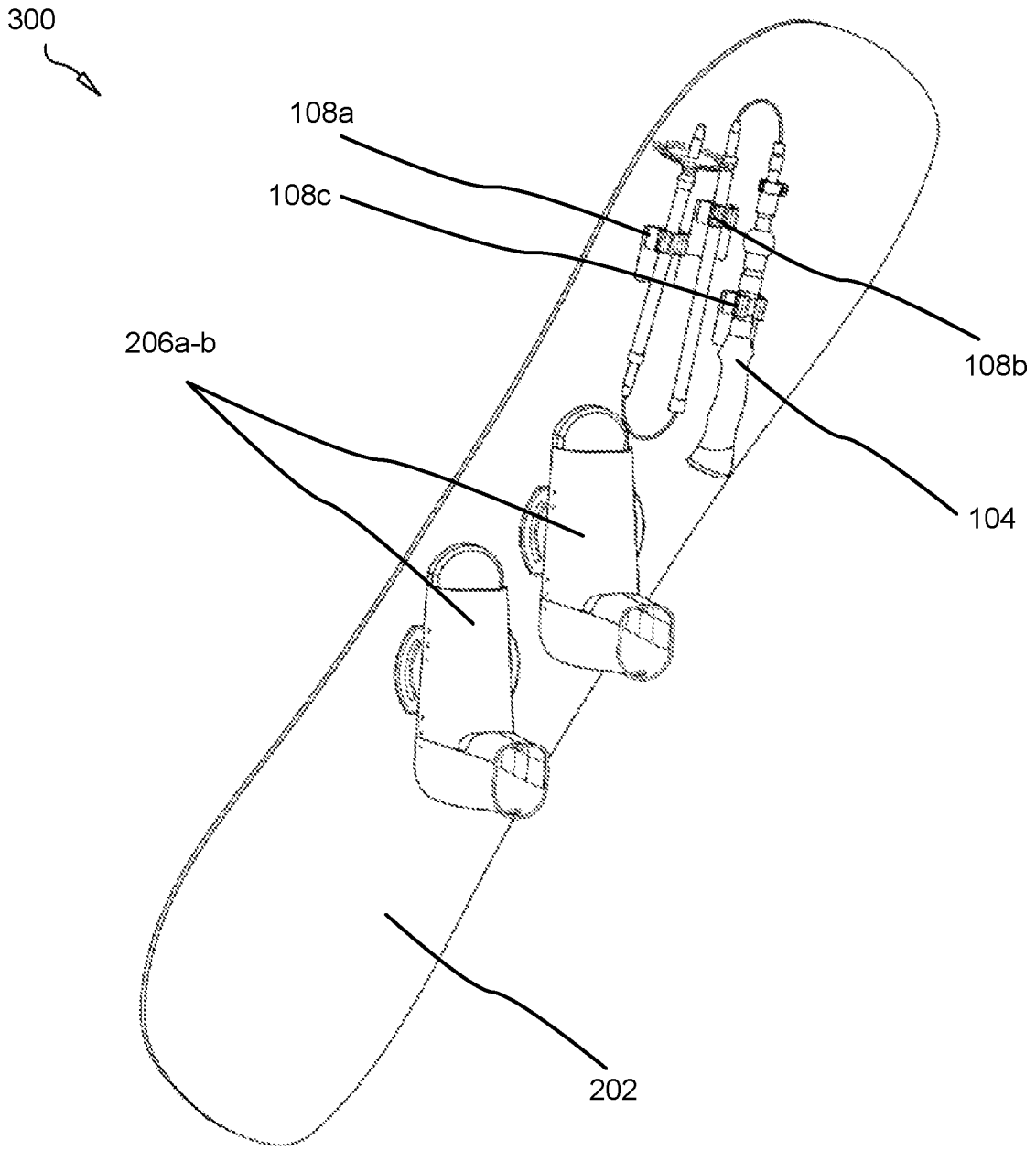
FIG. 3 is an environmental, top perspective view illustrating one embodiment of a detachable snowboard pole assembly in accordance with the present invention.

FIG. 3 is an environmental, top perspective view illustrating one embodiment of a detachable snowboard pole assembly in accordance with the present invention.

In various embodiments, the clamp 108*a* is spaced in close proximity to the clamp 108*b* wherein the clamp 108*b* is space in further proximity from clamp 108*c* to accommodate the handle and basket tip 112 of the pole 104. The clamps 108*a-c* are mounted forward of the bindings 206 on the longest axis of the snowboard 202 where a snowboarder can more easily lean forward than backward.

Figure 4:
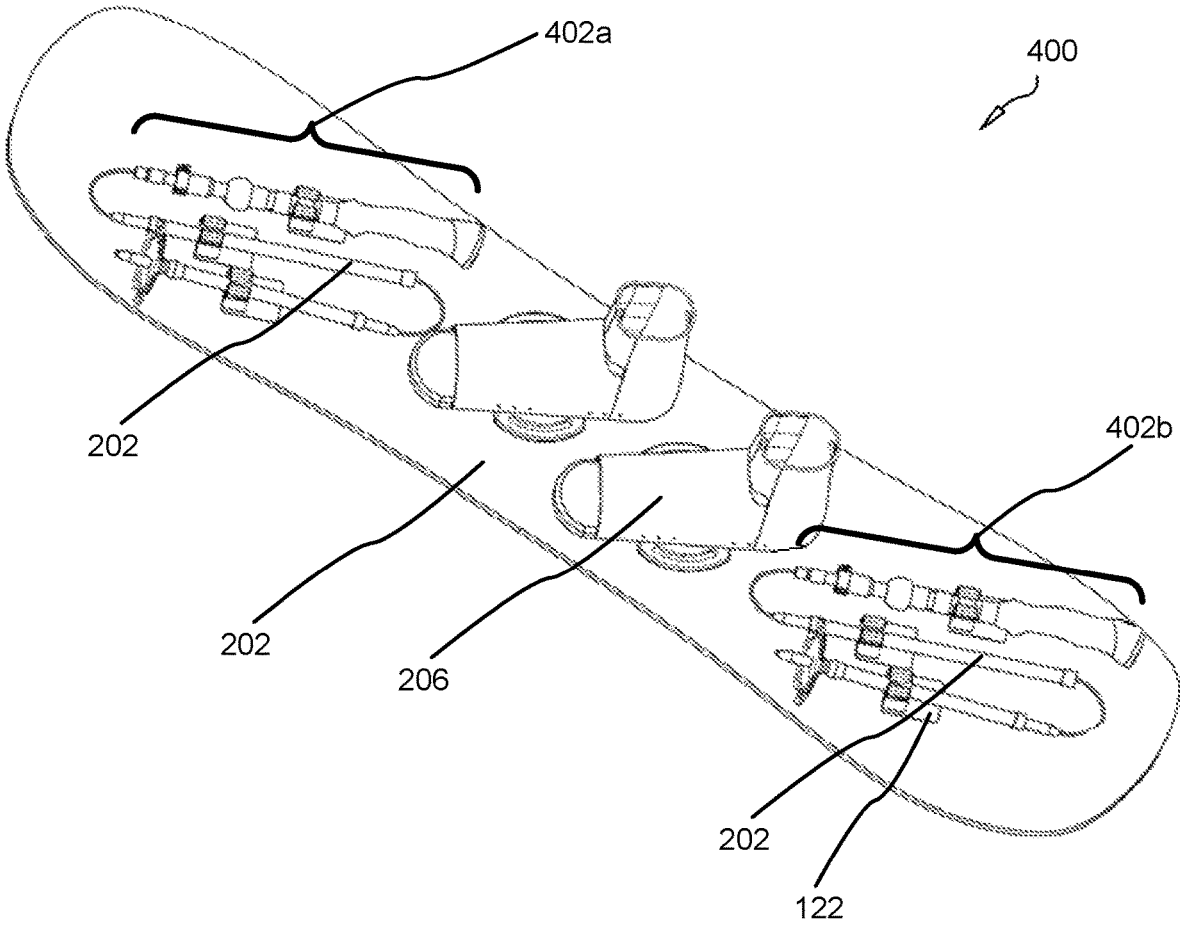
FIG. 4 is an environmental, top perspective view illustrating one embodiment of a detachable snowboard pole assembly in accordance with the present invention.

FIG. 4 is an environmental, top perspective view illustrating one embodiment of a detachable snowboard pole assembly 400 in accordance with the present invention.

The affixment assemblies 402*a-b* comprise all of the components added to the top surface of the snowboard 202 for affixing a single pole to the snowboard 202, including clamps 108, pole 104, and mounting brackets 122. In the shown embodiment, the apparatus 400 comprises two affixment assemblies 402, but may comprise any plurality of affixment assemblies 402. One affixment assembly 402*a* is disposed forward of the bindings 206. A second affixment assembly 402*b* is disposed rearward on the surface of the board 202 behind the bindings 206. In still further embodiments, an affixment assembly 402 may be disposed between the boots 206. In some embodiments, the affixment assemblies are distributed across the surface of the board 202 from front to back.

Figure 5:
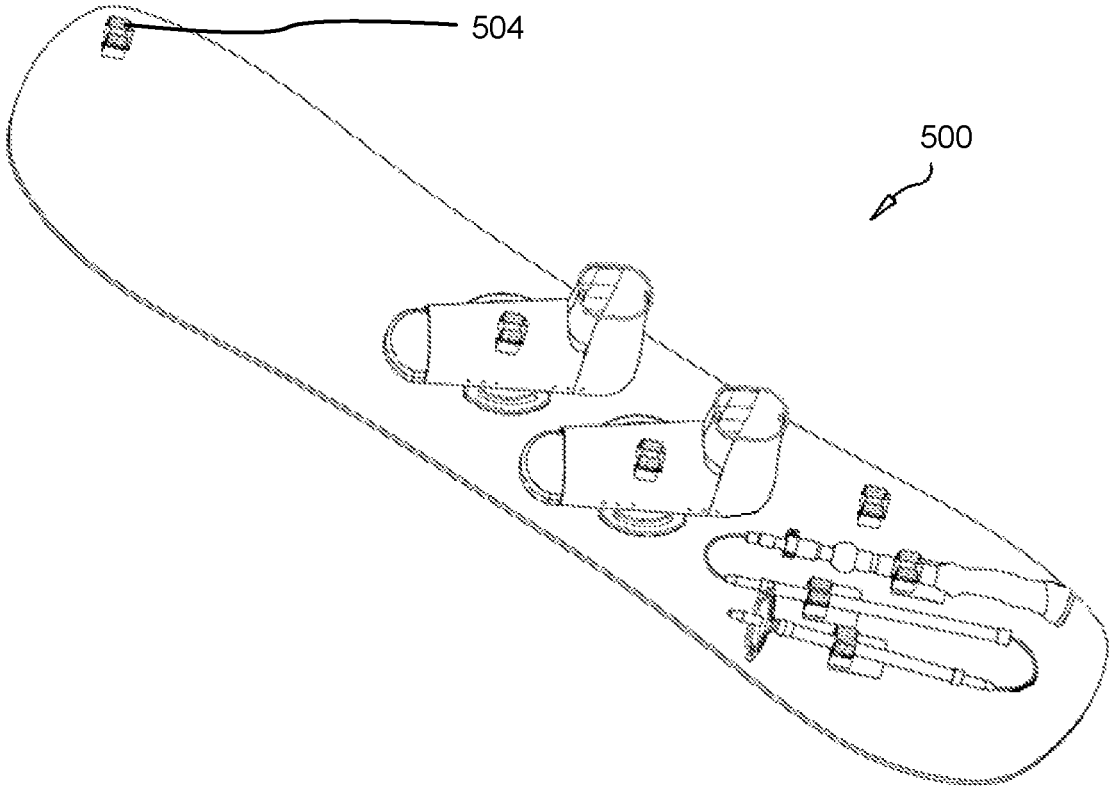
FIG. 5 is an environmental, top perspective view illustrating one embodiment of a detachable snowboard pole assembly in accordance with the present invention.
Figure 6:
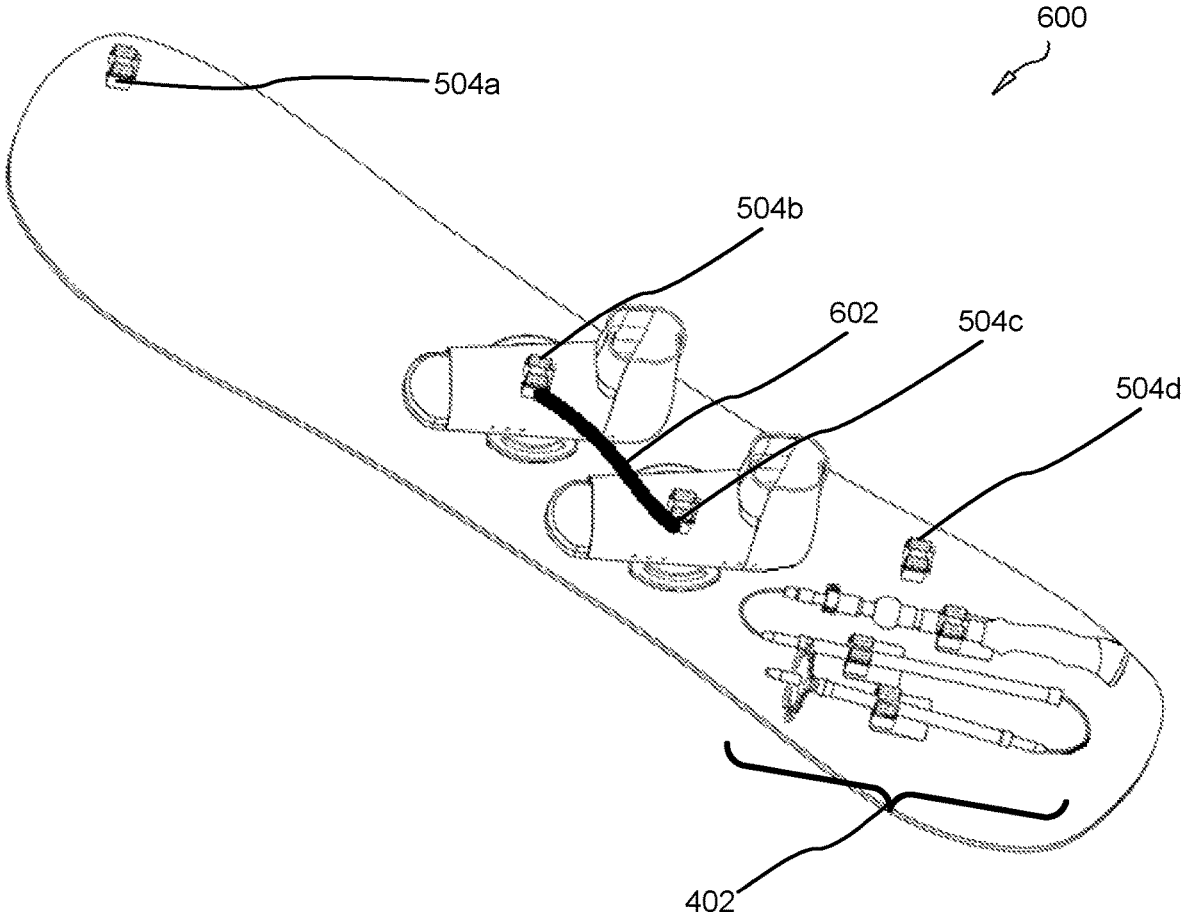
FIG. 6 is an environmental, top perspective view illustrating one embodiment of a detachable snowboard pole assembly in accordance with the present invention.

FIGS. 5-6 illustrate environmental, top perspective views of a detachable snowboard pole assembly 500, 600 in accordance with the present invention.

The apparatus 500 comprises clamps 108 and mounting brackets 122 assembled into a clamp assembly 504. In some embodiments, clamp assemblies 504*b-c* position on top of the bindings 206 and are affixed thereto. In still further embodiments, a flexible polymeric strap 602 operable as a handle to lift the board 202 is affixed to the clamp assemblies 504 above the bindings 206. In some embodiments, the clamp assemblies 504*b-c* are operable to allow affixation of accessories such as a water bottle, pouches, and the like.

In various embodiments, a plurality of clamp assemblies 504*a*, 504*d* position along the perimeter of one or more sides of the board 202, functionable to mount a collapsible or noncollapsible pole on a board 202 surface. In various embodiments, these clamp assemblies 504*a*, 504*d* are mounted in parallel.

In some embodiments, the clamp assembly 504*d* is mounted near the other clamps in the affixment assembly 402. The clamp assembly 504*d* may be mounted in parallel with one or more of these other clamps so as to allow the clamp assembly 504*d* to be used interchangeably with the pole in the affixment assembly 402 or another pole mounted along the right, out side of the board 202.

In various embodiments, the clamp assembles 504*a*, 504*d* are mounted within three to seven inches of the perimeter of the snowboard 202.

Figure 7:
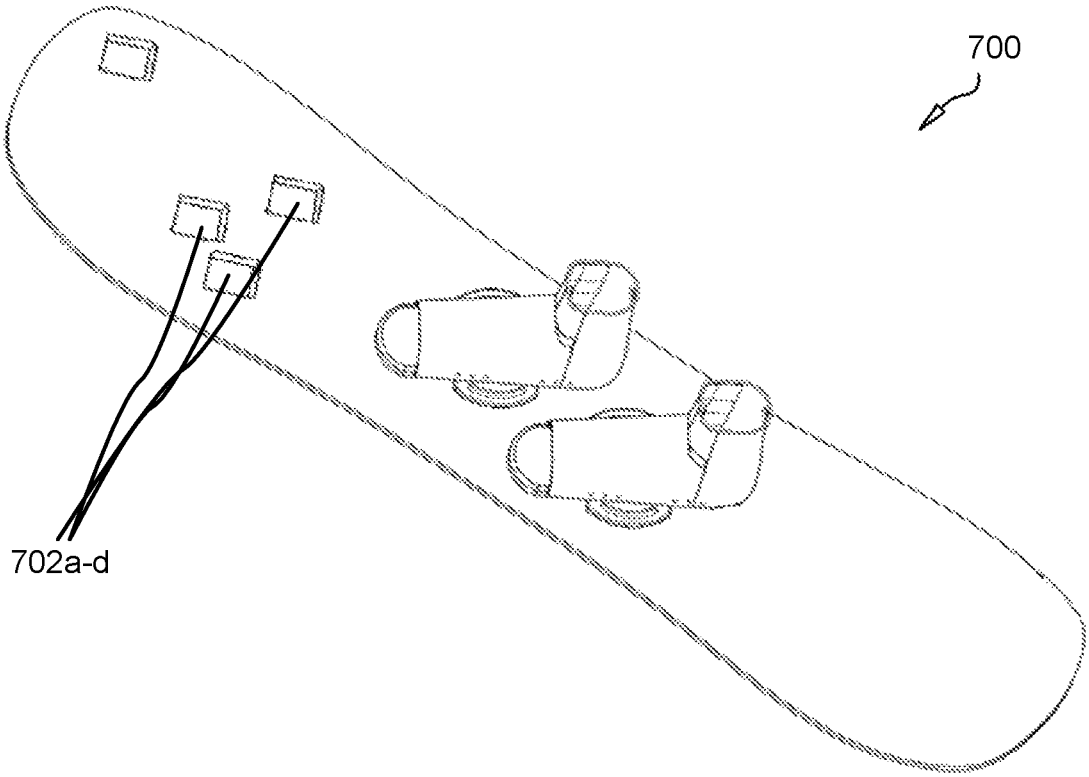
FIG. 7 is a top perspective view illustrating one embodiment of a detachable snowboard pole assembly and snowboard 700 in accordance with the present invention.

FIG. 7 is a top perspective view illustrating one embodiment of a detachable snowboard pole assembly and snowboard 700 in accordance with the present invention.

In various embodiments, a plurality of circular or rectangular recesses 702 are carved into the top surface of the board 202 for receiving correspondingly-shaped mounting brackets of clamp assemblies 504.

In all of the shown embodiments 100-700, the embodiments may consist of or comprise the shown components.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A detachable snowboard pole attachment assembly, the snowboard pole assembly comprising:

a snowboard having a top surface and two boot bindings, each boot binding comprising a clamp;

a first affixment assembly comprising a collapsible pole and a plurality of clamps affixed to the top surface of the snowboard, the clamps affixed in parallel orientation, staggered across the top surface of the board, the clamps adapted to form a friction fit with a collapsible pole, the clamps comprising a mounting bracket, wherein the first affixment assembly is positioned forward of the boot bindings;

a second affixment assembly comprising a collapsible pole and a plurality of clamps affixed to the top surface of the snowboard, the clamps affixed in parallel orientation, staggered across the top surface of the board, the clamps adapted to form a friction fit with a collapsible pole, the clamps comprising a mounting bracket, wherein the second affixment assembly is positioned rearward of the boot bindings;

a collapsible pole having a plurality of interconnected segments, each segment received by a clamp.

2. The snowboard pole attachment assembly of claim 1, wherein the top surface is one of planar and concave.

3. The snowboard pole attachment assembly of claim 1, wherein the plurality of clamps are mounted either forward of the bindings or rearward of the bindings.

4. The snowboard pole attachment assembly of claim 1, wherein the snowboard consists of three clamps.

5. The snowboard pole attachment assembly of claim 1, wherein the clamps are oriented substantially in parallel with one or more of the bindings.

6. The snowboard pole attachment assembly of claim 1, wherein each clamp comprises two rollers.

7. The snowboard pole attachment assembly of claim 1, wherein two of the clamps are spaced in close proximity to one another such that a distance between a second and third clamp exceeds the distance between a first and second clamp.

8. The snowboard pole attachment assembly of claim 7, wherein a distance between a tip of a forward binding and the first clamp is substantially equal to a distance between the tip of the forward binding and the third clamp.

9. The snowboard pole attachment assembly of claim 7, wherein a distance between a tip of a forward binding and the first clamp is substantially equal to a distance between the tip of the forward binding and the second clamp.

10. The snowboard pole attachment assembly of claim 7, wherein the pole comprises three segments.

11. The snowboard pole attachment assembly of claim 1, wherein the clamps are oriented at 20 to 45 degrees off a long axis of the snowboard.

12. The snowboard pole attachment assembly of claim 1, further comprising one or more handles affixed to two or more of the clamps including the clamps affixed to the of the bindings.

13. A detachable snowboard pole attachment assembly, the snowboard pole assembly consisting of:

a snowboard having a top surface and two boot bindings;

a first affixment assembly comprising a collapsible pole and a plurality of clamps affixed to the top surface of the snowboard, the clamps affixed in parallel orientation, staggered across the top surface of the board, the clamps adapted to form a friction fit with a collapsible pole, the clamps comprising a mounting bracket;

a plurality of secondary clamps affixed in parallel within five inches of a side of the snowboard;

a collapsible pole having three segments, each segment received by a clamp;

wherein the top surface is one of planar and concave;

wherein the snowboard consists of three clamps;

wherein the clamps are oriented substantially in parallel with one or more of the bindings;

wherein the clamps are oriented at 20 to 45 degrees off a long axis of the snowboard.

14. The snowboard pole attachment assembly of claim 13, wherein the clamps are adhered to the top surface of the snowboard.

15. The snowboard pole attachment assembly of claim 1, wherein the clamps comprise a baseplate abutting the snowboard shaped as one of square, circular, avoid, rectangular, octagonal, polygonal, and triangular.

16. The snowboard pole attachment assembly of claim 15, wherein the baseplates are formed as a single integrated piece.

17. A detachable snowboard pole attachment assembly, the snowboard pole assembly consisting of:

a snowboard having a top surface and two boot bindings, the snowboard defining a plurality of recesses adapted to receive a mounting plate of a clamp;

a first affixment assembly comprising a collapsible pole and a plurality of clamps affixed to the top surface of the snowboard, the clamps affixed in parallel orientation, staggered across the top surface of the board, the clamps adapted to form a friction fit with a collapsible pole, the clamps comprising a mounting bracket;

a plurality of secondary clamps affixed in parallel within five inches of a side of the snowboard;

a collapsible pole having three segments, each segment received by a clamp;

wherein the top surface is one of planar and concave;

wherein the snowboard consists of three clamps;

wherein the clamps are oriented substantially in parallel with one or more of the bindings;

wherein the clamps are oriented at 20 to 45 degrees off a long axis of the snowboard.

18. The snowboard pole attachment assembly of claim 17, further comprising a flexible, polymeric handle interconnected two clamps.

* * * * *